US005547104A

United States Patent [19]

Parker

[11] Patent Number: 5,547,104

[45] Date of Patent: Aug. 20, 1996

[54] WASTE CONTAINER WITH DUMP HANDLE

[75] Inventor: Brian G. Parker, Alto, Mich.

[73] Assignee: Cascade Engineering, Inc., Grand Rapids, Mich.

[21] Appl. No.: 289,018

[22] Filed: Aug. 11, 1994

[51] Int. Cl.[6] ..... B65D 25/28

[52] U.S. Cl. ..... 220/772; 220/908; 220/771; 220/769

[58] Field of Search ..... 220/908, 756, 220/769, 770, 771, 772

[56] References Cited

U.S. PATENT DOCUMENTS

| | | | |
|---|---|---|---|
| 3,366,397 | 1/1968 | Zeilstra et al. . | |
| 3,876,223 | 4/1975 | O'Reilly et al. . | |
| 4,836,394 | 6/1989 | Glomski . | |
| 4,927,046 | 5/1990 | Armstrong | 220/771 |
| 4,930,649 | 6/1990 | Moser | 220/771 |
| 4,969,571 | 11/1990 | Bartz | 220/771 |
| 4,969,813 | 11/1990 | Lee et al. . | |
| 5,050,762 | 9/1991 | Giorgi . | |
| 5,088,750 | 2/1992 | Beese et al. . | |
| 5,141,124 | 8/1992 | Smith et al. . | |
| 5,165,564 | 11/1992 | Prout et al. . | |
| 5,390,818 | 2/1995 | LaBuda | 220/908 |

*Primary Examiner*—Stephen J. Castellano
*Attorney, Agent, or Firm*—Varnum, Riddering, Schmidt & Howlett LLP

[57] ABSTRACT

A waste container having a container body to an upper portion of which is pivotally mounted a lid. A wheel and axle assembly is mounted to a lower portion of the container body to aid in the movement of the waste container. The waste container has an upper handle disposed near the upper portion of the container body and a lift handle disposed near the lower portion of the container body in opposing and vertically aligned relationship to the upper handle. The opposing relationship of the upper handle and the lift handle provides for a person to grasp the upper handle and the lift handle to lift and invert the waste container into a receiving vehicle to dump the contents of the waste container.

18 Claims, 5 Drawing Sheets

WASTE CONTAINER WITH DUMP HANDLE

BACKGROUND OF THE INVENTION

1. Field of the Invention

This invention relates to a waste container, and more specifically, to a waste container having a dump handle for ease of lifting and dumping the contents of the waste container.

2. Description of Related Art

With the advent of curbside residential waste collection, large capacity waste containers have become more popular. Typically, the waste containers are supported by wheels mounted on an axle so that they can be easily moved to the curbside prior to the predetermined collection time. The waste containers typically comprise a body to which is pivotally mounted a lid. The lid is often pivotally mounted to an integrally molded handle extending from the body.

The waste in the waste container can be collected in many different ways. Some systems use a lifting bar that is attached to the waste collection vehicle to lift and invert the waste container so that the lid pivots to an open position and the contents of the waste container are disposed in the collection vehicle.

The waste can also be collected by a purely manual method in which a person lifts and inverts a waste container to dump the contents into the collection vehicle. Typically, the waste collection person grasps the handle to which the lid is pivotally mounted and a lower portion of the waste container to lift and invert the waste container. Often, there is no special hand hold for the waste collection person to grasp near the lower portion of the container body, making the lifting and the inverting of the waste container difficult.

It is desirable that the waste container have a suitable lower hand hold in opposing relationship to the upper handle so that the waste container can be easily lifted and inverted by a waste collection person. It is also desirable that the hand hold be simple and mounted to or integral with the body of the waste container. The waste container and handle are preferably manufactured by a suitable molding process, such as injection molding, roto-molding, or blow-molding.

SUMMARY OF THE INVENTION

The invention relates to a waste container for receiving and storing waste material. The waste container has a container body formed by a front wall, rear wall, sidewalls and a bottom wall, which together define a waste receiving area in which the waste material is received and stored. Axle mounting plates are disposed on the bottom wall of the container body and an upper handle is disposed at an upper portion of the rear wall. A wheel assembly having an axle and wheels is mounted beneath the bottom wall of the container body with the axle mounted to the axle mounting plates and the wheels to the axle. A recess is formed at a bottom portion of the rear wall, above the mounting plates, and is joined to a recess in the bottom wall. The rear wall and bottom wall recesses define a handle web at their junction. The handle web forms a lower handle at the bottom of the rear wall of the container for lifting the container in conjunction with the upper handle.

Preferably, a lid is pivotally mounted to an upper portion of the rear wall or to the handle on the upper portion of the rear wall. The handle web forming the lower handle is flush with the rear wall so that the lower handle does not interfere with the non-lifting operations of the waste container.

The bottom wall has an indented portion from which the axle mounting plates depend and the bottom wall recess is formed in the bottom wall between the axle mounting plates. The bottom wall recess and the rear wall recess can be integrally molded into the container body. Preferably, the upper and lower handles are in vertically aligned relationship.

BRIEF DESCRIPTION OF THE DRAWINGS

The invention will now be described with reference to the drawings wherein.

DESCRIPTION OF THE PREFERRED EMBODIMENTS

Figure 1:
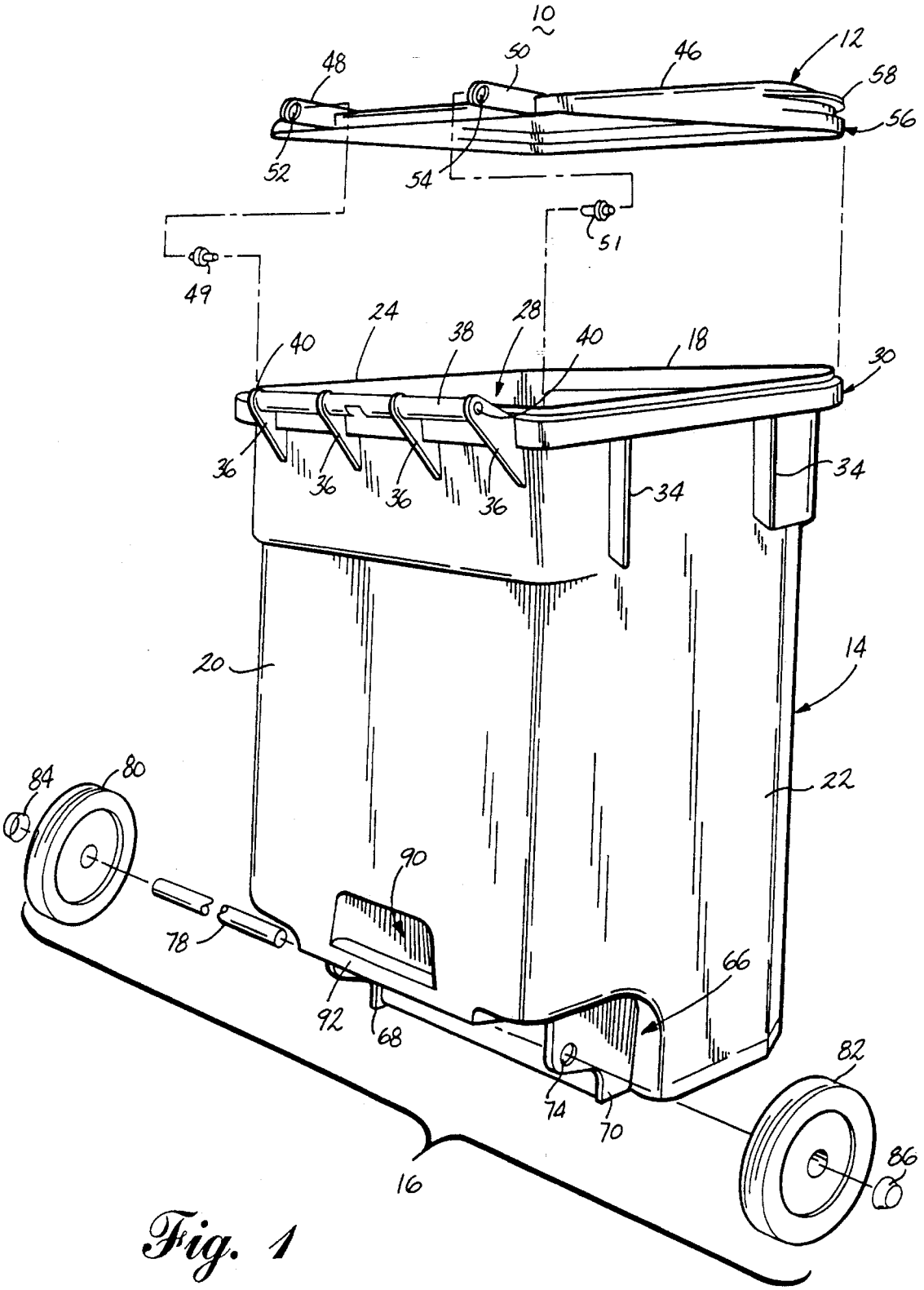
FIG. 1 is an exploded view of the waste container according to the invention.

Referring now to the drawings and to FIG. 1 in particular, a waste container 10 comprises a lid assembly 12, container body 14 and wheel assembly 16. Referring to FIGS. 1, 4, 5 and 7, the container body 14 is molded as a single integral piece and comprises front wall 18, rear wall 20 and side walls 22, 24 and bottom wall 26. The front wall 18, rear wall 20, side walls 22, 24 and bottom wall 26 define a waste receiving area 28 in which the discarded waste can be stored.

The upper portion of the container body 14 has a rim 30 extending about the perimeter of the container body 14. A plurality of ribs 32 (FIG. 5) are disposed between the rim 30 and the container body 14 to provide structural support for the rim 30. Also, a plurality of stacking ribs 34 are disposed between the container body 14 and the rim 30 and extend downwardly along the walls of the container body 14 to provide stacking supports when multiple waste containers 10 are nested for shipping.

Figure 2:
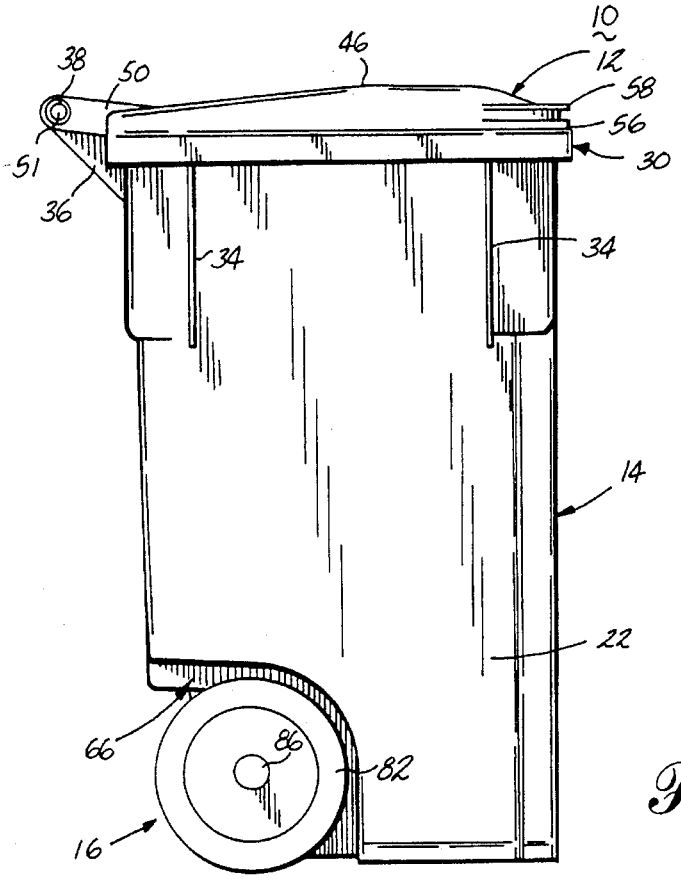
FIG. 2 is a side elevational view of the assembled waste container of FIG. 1.
Figure 3:
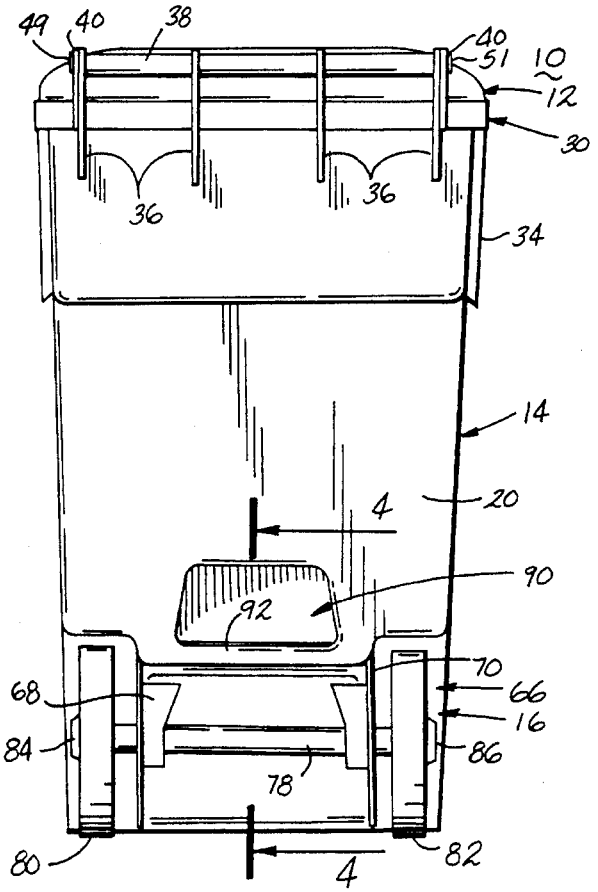
FIG. 3 is a rear elevational view of the waste container of FIG. 2.
Figure 4:
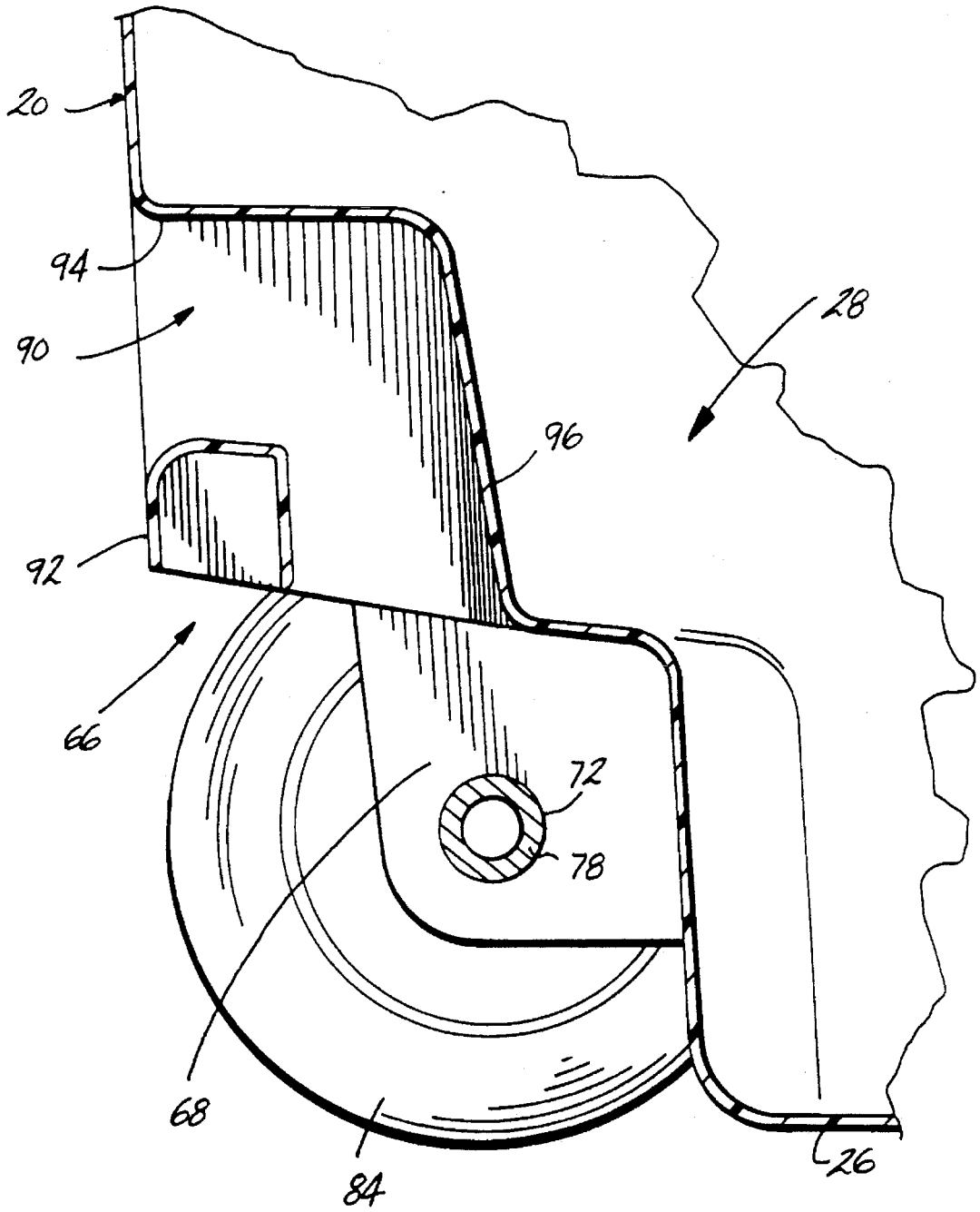
FIG. 4 is a partial sectional view along line 4—4 of FIG. 3.
Figure 5:
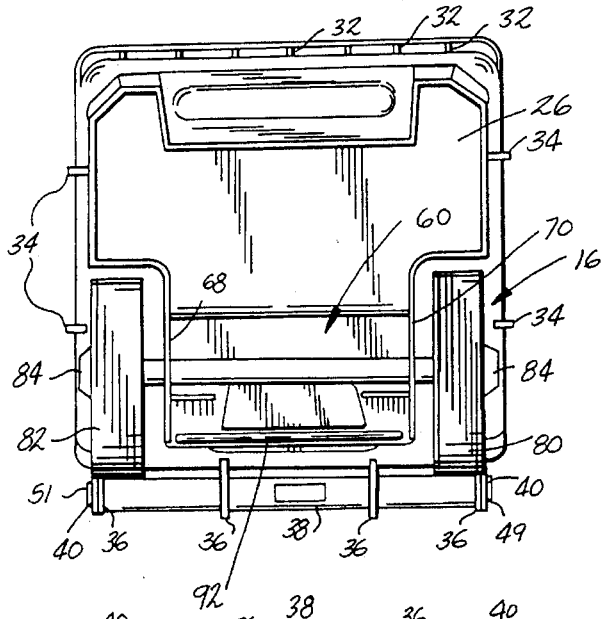
FIG. 5 is a bottom view of the waste container of FIG. 2.
Figure 6:
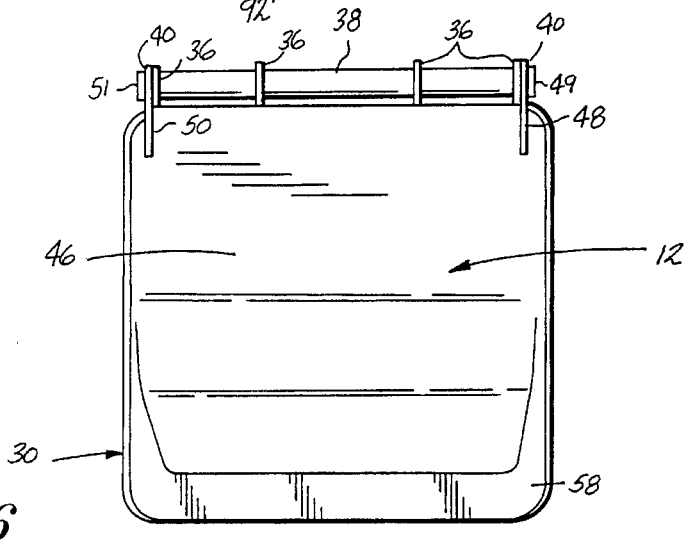
FIG. 6 is a top view of the waste container of FIG. 2 with the lid of the waste container in the closed position.
Figure 7:
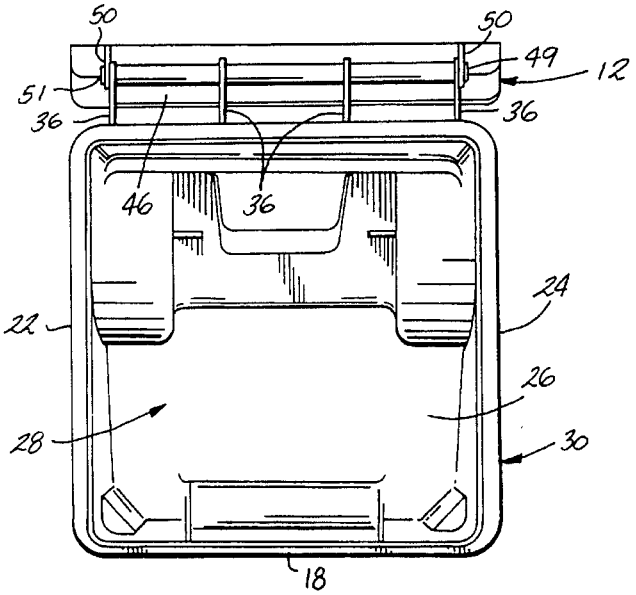
FIG. 7 is a top view similar to FIG. 6, except that the lid is in the open position.

As best seen in FIGS. 1–3, multiple handle supports 36 are formed in one of the walls, preferably the rear wall 20, and mount at their upper end a tubular handle 38 in which plugs 49, 51 (FIGS. 5–7) are received in the ends 40 of the tubular handle. The handle supports 36 support the tubular handle 38 in a position disposed away from the side wall providing sufficient spacing between the handle 38 and the rear wall 20 for a user to grasp the handle 38 without being hindered by the rear wall 20.

Referring to FIGS. 1–7, the lid assembly 12 pivotally mounts to the tubular handle 38 of the container body 14. The lid assembly 12 comprises a lid 46 from which extend mounting flanges 48 and 50, each having an aperture 52 and 54, respectively. The lid 46 has a lip 56 extending about the perimeter of the lid 46. A lifting edge 58 (FIG. 1) extends from the lid 46 and is structurally supported by a plurality of webs 60 extending between the lip 56 and the lifting edge 58. The lifting edge 58 provides a surface for the user of the waste container 10 to lift the lid. The lid 46 is pivotally mounted to the container 14 by press fitting the plugs 49, 51 into the apertures 52 and 54 of the mounting flanges 48 and 50. The press fit between the plugs 49, 51 and the flanges 48 and 50 is sufficient to securely mount the lid 46 to the container body while providing for the rotation of the lid 46 about the longitudinal axis of the tubular handle 38 so that the user can lift the lid 46 and rotate it to gain access to the waste receiving area 28.

Referring to FIGS. 1–4, the bottom wall 26 of the container body 14 has a recess area or indented portion 66 in which two opposing axle ribs 68 and 70 are disposed. The axle ribs 68 and 70 each have apertures 72 and 74, respectively, that are used in the mounting of the wheel assembly 16 to the container body 14.

The wheel assembly 16 comprises an axle 78 to which opposed wheels 80, 82 are rotatably mounted. Axle caps 84 and 86 retain the wheels 80, 82 on the axle 78. To mount the wheel assembly 16 to the container 14, the axle 78 is passed through the apertures 72 and 74 of the axle ribs 68 and 70. The wheels 80 and 82 are then mounted to the axle by passing the axles 78 through openings in the wheels 80 and 82. The wheels are then fixed on the axle by press fitting axle caps 84 and 86 to the ends of the axles 78.

A lift handle recess 90 is formed in the rear wall 20 of the container body 14 and extends into the recess area 66 in the bottom wall 26. Preferably, the lift handle recess is disposed directly above the recess area 66, but can be disposed at any suitable location. A downwardly opening generally U-shaped lift handle 92 extends across the bottom of the lift handle recess 90. Lift handle recess 92 is defined in part by a generally horizontal wall 94 and a generally vertical wall 96 that extends downwardly from the generally horizontal wall 94 to the recess area 66. By positioning the lift handle 92 rearwardly from the generally vertical wall 96 at the lower edge of the lift handle recess and above the recess area 66, the user of the waste container 10 can easily grasp the lift handle 92 without interference from any portion of the container body 14 or the wheel assembly 16. Also, when the lid 12 is open and resting against the rear wall 20, the lid 12 will not interfere with the lift handle 92. Preferably, the lift handle 92 is disposed flush with the rear wall 20 so that the lift handle 92 does not interfere with the other operations of the waste container 10. The position of the lift handle 92 near the lower end of the container body 14 advantageously complements the tubular handle 38 so that the user can grasp the tubular handle 38 with one hand and the lift handle 92 with another hand to lift the waste container 10 from the ground to the disposal vehicle where the container is inverted. The lid 46 pivots about the tubular handle 38 to open the waste receiving area 28 so that the contents of the waste container can be dumped into the disposal vehicle.

Figure 8:
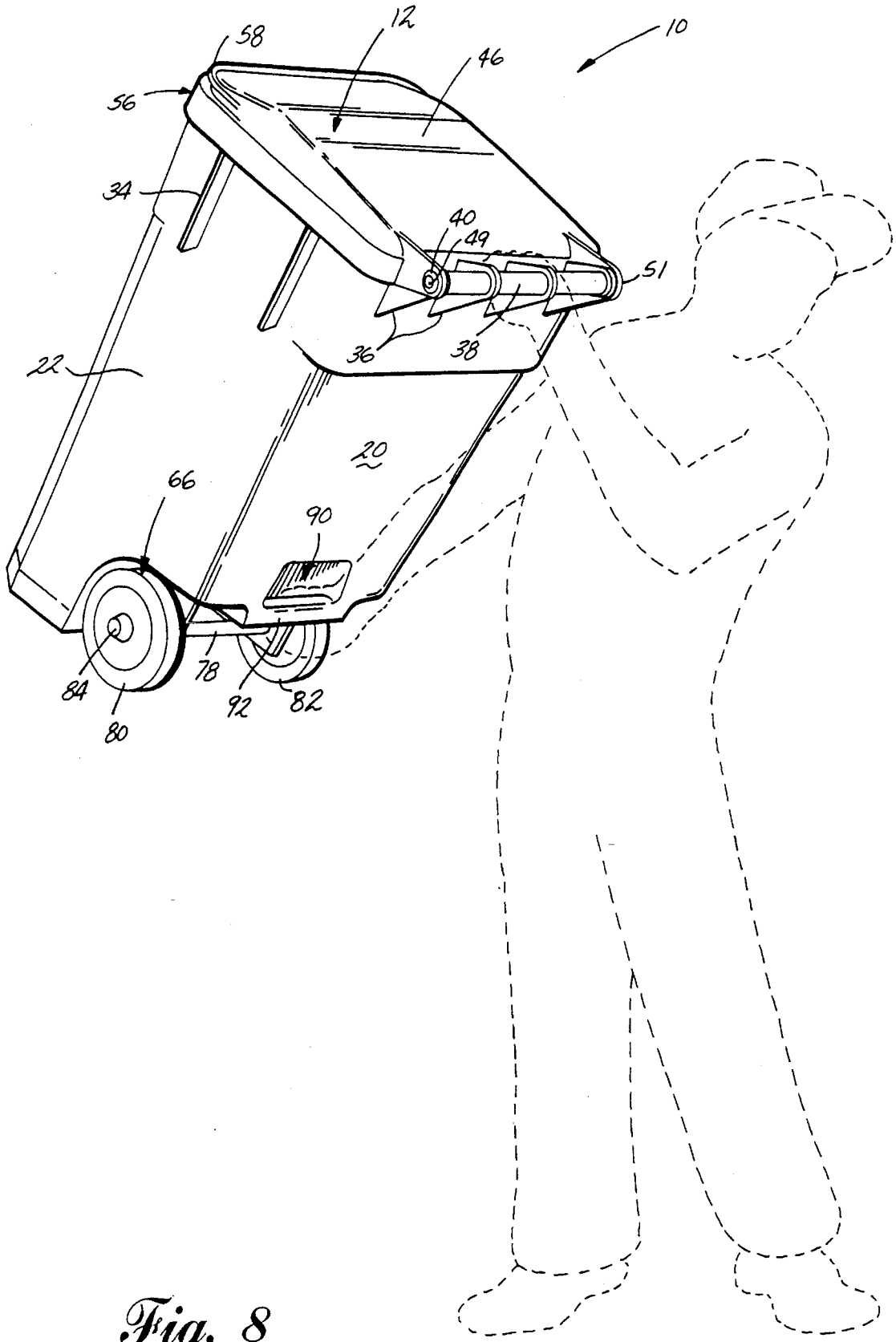
FIG. 8 is perspective view of an operator lifting the waste container in FIG. 1.

In operation, the waste receiving area 28 is filled with waste. The waste container 10 is tilted rearwardly and rolled by pushing or pulling on handle 38 to the curb or other desired location on the wheels 80, 82. Upon the arrival of the waste collector, a user grasps the handle 38 with one hand and the lift handle 92 with the other hand to lift the waste container 10 toward a waste collection vehicle as illustrated in FIG. 8. Depending on the weight of the filled waste container 10, the waste collector may lift and invert the waste container in a single motion. Alternatively, the waste collector can rest the upper portion of the waste container on the waste collection vehicle and continue lifting the waste container 10 by the lift handle 92 and invert the waste container 10. When inverted, the lid 46 rotates about handle 38 to an open position and the waste is deposited in the waste collection vehicle.

The lift handle 92 is a convenient and secure grip for the user to lift the container 10 and hold the container in inverted position as it is being dumped. Further, the lift handle 92 can also be used to move and lift the waste container 10 in circumstances other than the collection of waste, for example, in carrying the empty waste container up or down a flight of stairs.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A waste container for receiving and storing waste material and comprising:

a container body comprising:

a front wall, a rear wall, side walls, and a bottom wall, which together define a waste receiving receptacle;

axle mounting plates on the bottom wall; and an upper handle disposed at an upper portion of the rear wall;

a wheel assembly having an axle mounted to the axle mounting plates and wheels mounted to the axle in a position adjacent the bottom wall of the container body;

a recess in the rear wall at a bottom central portion thereof above the mounting plates and defined in part by a downward wall extending to the bottom wall;

a handle web joined to the rear wall at a lower end of the rear wall recess rearwardly of the downward wall, the rear wall recess forming a handle opening for gripping the handle web;

whereby the handle web forms a lower handle at the bottom of the rear wall of the container body for lifting the container in conjunction with the upper handle formed at the upper portion of the rear wall.

2. A waste container according to claim 1 and further comprising a lid pivotally mounted to the upper portion of the rear wall for closing the waste receiving area.

3. A waste container according to claim 2 wherein the lid is pivotally mounted on an axis in alignment with the upper handle.

4. A waste container according to claim 1 wherein the handle web is substantially flush with the rear wall.

5. A waste container according to claim 1 wherein the the rear wall recess is integrally molded into the container body.

6. A waste container according to claim 1 wherein the upper handle is disposed vertically above the lower handle and in general alignment therewith to aid in the lifting of the waste container.

7. A waste container for receiving and storing waste material and comprising:

a container body comprising:

a front wall, a rear wall, side walls, and a bottom wall, which together define a waste receiving receptacle; and axle mounting plates on the bottom wall; and an upper handle disposed at an upper portion of the rear wall;

a wheel assembly having an axle mounted to the axle mounting plates and wheels mounted to the axle in a position adjacent the bottom wall of the container body;

a recess in the rear wall at a bottom central portion thereof above the mounting plates and defined in part by a generally vertical wall extending to the bottom wall;

the bottom wall has an indented portion from which the axle mounting plates depend, the rear wall recess extends into the bottom wall indented portion;

a handle web joined to the rear wall at a lower end of the rear wall recess, the handle web being spaced rearwardly from the generally vertical wall and extending across the rear wall recess, the rear wall recess forming a handle opening for gripping the handle web;

whereby the handle web forms a lower handle at the bottom of the rear wall of the container body for lifting the container in conjunction with the upper handle formed at the upper portion of the rear wall.

8. A waste container according to claim 7 wherein the rear wall recess extends into the wheel recess area between the axle mounting plates.

9. A waste container according to claim 7 and further comprising a lid pivotally mounted to the upper portion of the rear wall for closing the waste receiving area.

10. A waste container according to claim 9 wherein the lid is pivotally mounted on an axis in alignment with the upper handle.

11. A waste container according to claim 7 wherein the handle web is substantially flush with the rear wall.

12. A waste container according to claim 7 wherein the upper handle is disposed vertically above the lower handle and in general alignment therewith to aid in the lifting of the waste container.

13. A waste container for receiving and storing waste material and comprising:

a container body comprising:

a front wall, a rear wall, side walls, and a bottom wall, which together define a waste receiving receptacle;

axle mounting plates on the bottom wall, and an upper handle disposed at an upper portion of the rear wall;

a wheel assembly having an axle mounted to the axle mounting plates and wheels mounted to the axle in a position adjacent the bottom wall of the container body;

a recess in the rear wall at a bottom central portion thereof above the mounting plates and defined in part by a generally vertical wall extending to the bottom wall;

a downwardly opening, generally U-shaped handle web joined to the rear wall at a lower end of the rear wall recess, the handle web being spaced rearwardly from the generally vertical wall and extending across the rear wall recess, the rear wall recess forming a handle opening for gripping the handle web; and the container body and generally U-shaped handle web being formed in one piece by injection molding;

whereby the handle web forms a lower handle at the bottom of the rear wall of the container body for lifting the container in conjunction with the upper handle formed at the upper portion of the rear wall.

14. A waste container according to claim 13 wherein the upper handle is disposed vertically above the lower handle and in general alignment therewith to aid in the lifting of the waste container.

15. A waste container according to claim 13 wherein the rear wall recess extends into the wheel recess area between the axle mounting plates.

16. A waste container according to claim 13 and further comprising a lid pivotally mounted to the upper portion of the rear wall for closing the waste receiving area.

17. A waste container according to claim 16 wherein the lid is pivotally mounted on an axis in alignment with the upper handle.

18. A waste container according to claim 13 wherein the handle web is substantially flush with the rear wall.

* * * * *